United States Patent [19]

Donahoe

[11] Patent Number: 4,938,380

[45] Date of Patent: Jul. 3, 1990

[54] TRASH/GARBAGE CONTAINER WITH EXTERNAL LINER RETAINERS

[76] Inventor: Michael T. Donahoe, 960 Chanel Ct., Concord, Calif. 94518

[21] Appl. No.: 796,613

[22] Filed: Nov. 8, 1985

[51] Int. Cl.[5] ..... B65D 90/04

[52] U.S. Cl. ..... 220/404; 220/1 T

[58] Field of Search ..... 220/407, 403, 404, 1 T

[56] References Cited

U.S. PATENT DOCUMENTS

| | | | |
|---|---|---|---|
| 4,418,835 | 12/1983 | Watts | 220/404 |
| 4,535,911 | 8/1985 | Goulter | 220/1 T X |
| 4,558,800 | 12/1985 | Isgar et al. | 220/403 |
| 4,576,310 | 3/1986 | Isgar et al. | 220/1 T X |
| 4,589,570 | 5/1986 | Auten | 220/404 |

*Primary Examiner*—Steven M. Pollard

*Attorney, Agent, or Firm*—Armand G. Guibert

[57] ABSTRACT

A trash container of molded type having a generally rectangular opening and provided with four ears, one at each corner, to support a bag liner with minimal interference during filling and removal. The liner is preferably one of the high-strength plastic bags having incorporated handles, which bags are currently given free-of-charge to grocery store customers for transport of their purchases. In particular, the ears are intended to have the handles looped around them such that the bag's sides hug the container walls, thus assuring that all refuse is captured within the liner bag. To this end, a tip of each ear protrudes beyond and above a rim around the opening, requiring the handles to be stretched over them, and a notch in the exterior of each ear near the container corner lies well below the rim, causing the bag's edges outside the handle area also to be held in desired relation to the walls.

11 Claims, 2 Drawing Sheets

TRASH/GARBAGE CONTAINER WITH EXTERNAL LINER RETAINERS

BACKGROUND OF THE INVENTION

1. Field of the Invention

The invention relates to trash/garbage containers and, more particularly, to those intended for use with removable liners, specifically those made of plastic for resistance to water, fatty liquids and other liquids often present in household refuse.

2. Prior Art

Lined containers of the household type have long been known, but two constant problems have been the need to provide close fit of the liner to the container walls so as to assure entry of refuse solely within the liner and also to prevent the inserted liner from slipping to the bottom of the container or onto the contents therein when one is dropping material into a lined container. None of the previously-known containers solved these problems efficiently—often requiring complex, costly, multi-part holding or clamping structures or being difficult to use even if simplified.

As examples of relevant art, U.S. Pat. No. 3,825,150 (issued July 23, 1974 to W. Taylor) shows a molded waste receptacle having integral tabs formed in its side walls, the tabs being pressed inwardly to engage a rolled-over edge of a liner bag and pinch it against the receptacle wall when pressing is ended. Simultaneous manipulation of both a tab and the edge requires some dexterity, and furthermore, occurrence of gaps between the liner bag and the wall is not prevented, allowing waste disposal to occur between liner and receptacle.

Next, U.S. Pat. No. 4,366,916 (issued Jan. 4, 1983 to J. Guido et al) shows a packing box for bulk quantities of flexible bags with carrying handles, the box being convertible into a packing unit for the bags, because of provision of pre-perforated front panel and side flaps, the latter folding upward to provide tabs upon which the bag handles are received. Control of gaps between bag and container is not provided and the box is not a leak-proof unit because of the pre-perforations.

U.S. Pat. No. 4,418,835 (issued Dec. 6, 1983 to A. Watts) shows a pair of wire brackets, each bracket supporting the handle of a liner bag and being fastened in spaced relation to the interior of a respective wall of a trash container. The spacing is necessary for accommodating the user's fingers while inserting and removing the bag, even though such spacing undesirably allows waste disposal to occur between bag and container. Furthermore, if the bag is overfilled, these internally-disposed brackets can present a barrier to easy removal of the liner even though the bag's handles are readily grasped.

Lastly, U.S. Pat. No. 4,498,652 (Feb. 12, 1985 to J. Malik) shows a wire rack for just suspending a plastic bag by its handle loops in an open-mouthed state of the bag, a protective wall being present on one side only (the rack being fastened to a cabinet door on that side).

Accordingly, there is need for a trash/garbage container in which liner support is provided in a simple, low-cost, easily-usable fashion, while eliminating gaps between the liner and the container walls that allow undesirable disposal outside the confines of the liner.

SUMMARY OF THE INVENTION

The invention resides in an improved trash/garbage container of the leak-proof, molded type having two end walls with a juncture at each lateral end thereof to a respective one of two side walls and defining a substantially rectangular opening at a top edge of the walls, together with a closure-forming piece attached to a lower edge of each wall to form a cavity; the improvement comprising a pair of spaced projecting members on the end walls, one member of the pair adjacent each juncture, both projecting members having a tip terminating outboard of the juncture with a respective one of the side walls; a bag liner insertable in the cavity, the liner being made of flexible, extensible material and having an upper end with handle loops thereon for carrying the liner and for engagement by the projecting members, spacing of the projecting members being sufficiently large relative to the handle loops as to maintain the loops in a stretched state when engaged therewith; and means on the projecting members holding at least a portion of the loops externally of the cavity and below the top edge of the walls, such that the projecting members are located externally of the cavity and support the liner in substantially wall-hugging and unobstructedly removable relation to the walls when engaged with the handle loops.

A primary object of the invention is to provide a substantially wall-hugging type of liner support.

It is yet another object of the invention to provide both a non-slip and also a substantially wall-hugging type of liner support.

A further object of the invention is to utilize as liners in the above-mentioned fashion, the flexible, extensible plastic bags of the type provided to consumers in merchandising operations for carrying their purchases.

Other objects and features of the invention will become evident from a reading of the ensuing description taken in conjunction with the drawing.

DESCRIPTION OF THE PREFERRED EMBODIMENT

Figure 1:
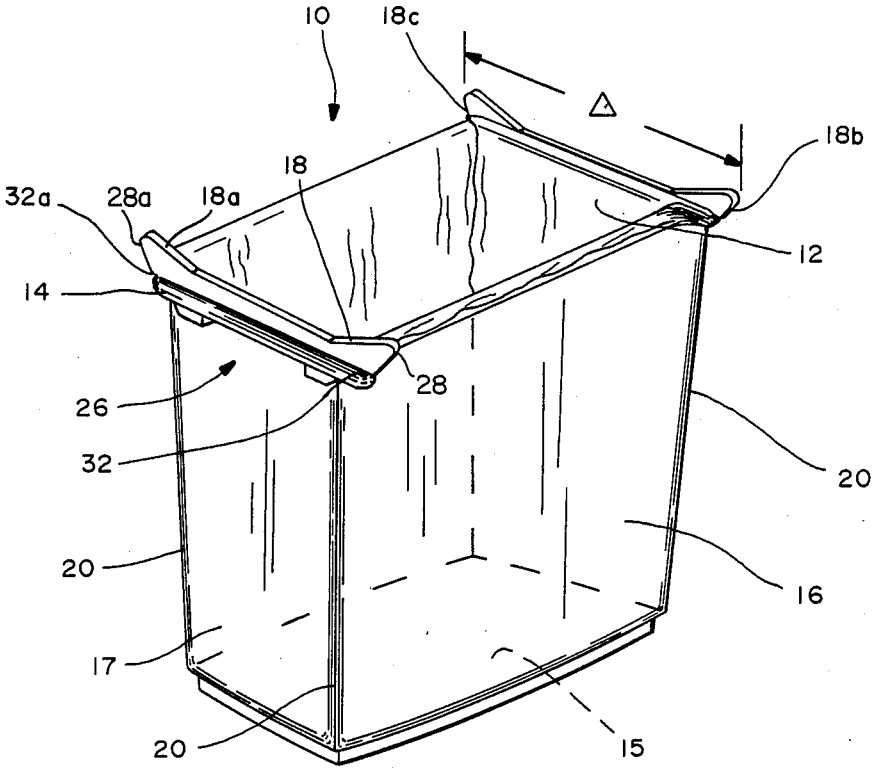
FIG. 1 shows an isometric view from above left of the container according to the invention, four members projecting above the usual container rim, each member being alignedly located on an end wall of the container adjacent a respective corner of the container, each projecting member extending beyond the side wall forming the corner.

A trash/garbage container 10 according to the invention is shown pictorially in FIG. 1. As seen, trash container 10 (as it will be referred to hereinafter for simplicity) is preferably a one-piece, molded plastic unit similar to household containers made by Rubbermaid Sales Corporation of Wooster, Ohio. Just as in these known units, container 10 comprises two end walls 17 and two side walls 16 which, together with bottom closure element 15 (indicated by dashed lines in FIG. 1), form a leak-proof receptacle (or "cavity") for trash, garbage, etc. Container 10 differs inventively over such prior devices, however, in that it includes members 18 projecting above the usually uppermost rim 22 of container 10, as discussed below, for purposes of providing not only positive support for an inserted bag-type plastic liner 12, but also for doing such in a fashion causing liner 12 to hug the walls 16,17; thus obviating the gaps commonly occurring between liner 12 and walls 16,17. Absence of such gaps assures that matter thrown into container 10 can only lodge inside liner 12.

Figure 2:
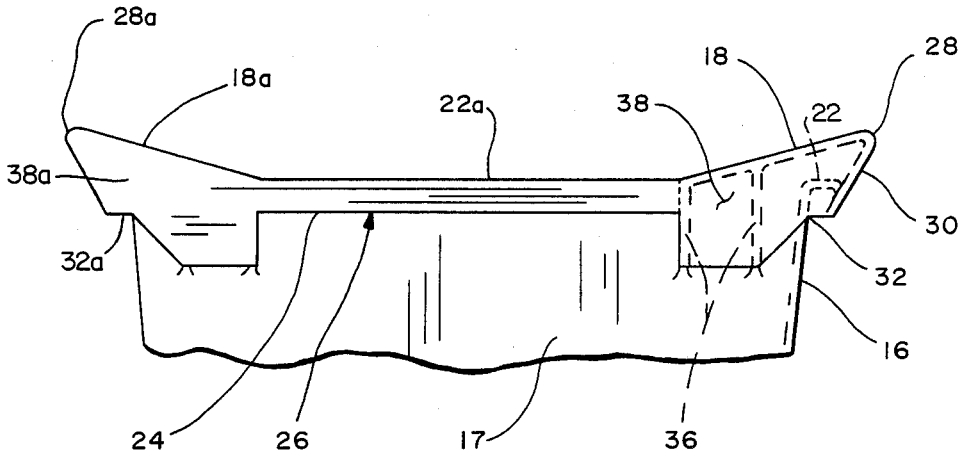
FIG. 2 is a side elevation view of a typical one of the four projecting members on the container of FIG. 1, two of which are identical, and the other two are mirror images of the first pair.

Members 18 are located at the corners 20 of container 10 in the region of end walls 17, each member 18 rising at a non-critical angle of about 10–20 degrees as it progresses outwardly toward rim 22, ending at a tip 28 which is preferably rounded somewhat. Tip 28 lies outboard of rim 22 which may be thicker in cross-section than the walls 16,17 for purposes of reinforcement. More preferably, it may be molded in an inverted channel form having a lip 24, as best shown in FIG. 2, where liner 12 has been omitted for greater clarity. This latter form is preferred for rim 22*a* because it may serve as a carrying grip 26, as shown at upper center on wall 17 in FIGS. 1 and 2.

As seen from FIG. 2, member 18 is shaped somewhat like a bat's ear, the portion 30 after tip 28 being turned downward and back (inclined slightly off vertical, about 5–10 degrees) such that it intercepts lip 24 and then turns sharply leftward (as viewed in FIG. 2) at about the level of lip 24, forming a notch-like structure 32 for anchoring purposes, as discussed in detail subsequently with respect to FIGS. 3 and 4. Ears 18 are of hollow form, each having an inner layer 34 (best seen in FIG. 3) integral with end wall 17 and essentially vertical or coplanar with this last, at least. Two or more webs 36 with roughly equal spacing between them reinforcingly connect layer 34 and a parallel exterior layer 38 to provide rigidity in known fashion. Layer 38 is preferably positioned substantially flush with lip 24 of rim 22*a* in the area of end wall 17, whereas in the area of side wall 16, rim 22 intersects layer 34 and is desirably faired into layer 34 slightly to reduce any tendency for stress cracking of the intersecting plastic.

Before discussing attachment of the liner handles 14 to the ears 18, it should be mentioned that the preferred bags for use herein are those given by merchandisers (e.g. grocery stores) to consumers for transport of their purchases. The bags are made of a flexible plastic film which is extensible yet exceptionally strong in deformation and in resistance to tearing, even if pierced. Specifically, bags typically of the preferred type are those known as MARKET TOTE (TM) supplied commercially by Mobil Chemical Company of Woodland, California. Since these bags are provided "free" to the customer and constitute a nuisance if other than proper disposition of them is made, it is desirable to recycle them as refuse collectors.

Figure 3:
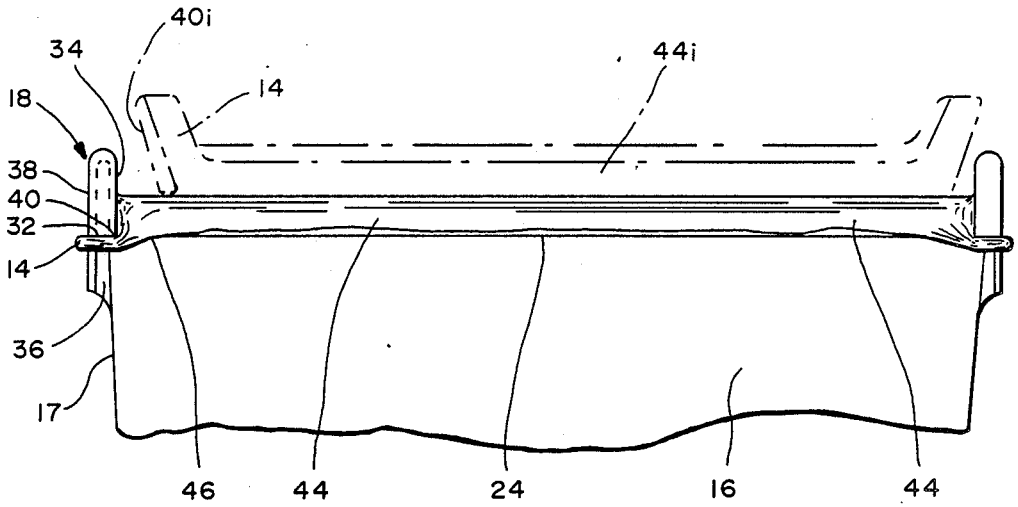
FIG. 3 is an end elevation view of the projecting member of FIG. 2.
Figure 4:
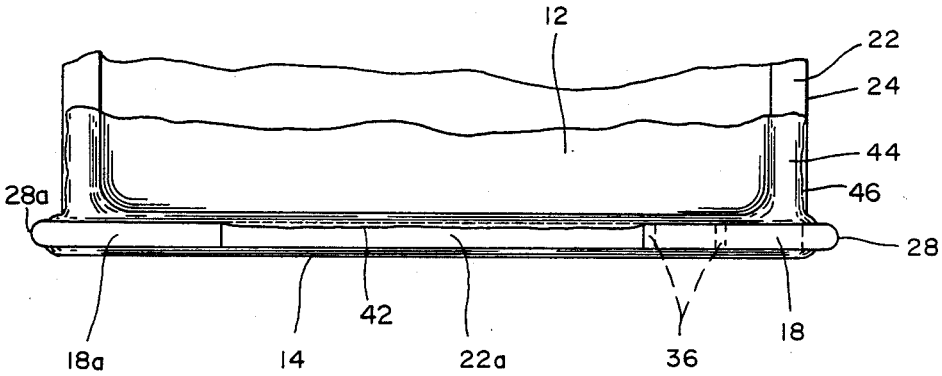
FIG. 4 is a plan view of the projecting member shown in FIG. 2.

Turning now to FIG. 3—another elevation view of ear 18, but looking toward tip 28—liner 12 is shown (dashed lines) prior to attachment to ears 18 according to the invention, the handle 14—usually of doubled thickness for added strength—being shown with its open loop 40*i* (dashed lines) raised above right-hand ear 18 alongside inner layer 34. From this initial position, handle 14 is manipulated—by insertion of the user's index finger (not shown) in loop 40*i* and pulling in the appropriate direction—so as to pass over ear 18 and downward sufficiently to engage notch 32 (solid lines). Direction of finger motion is then reversed, engaged loop 40 then being pulled leftward toward tip 28*a* of the left-hand ear 18*a* (see FIG. 1) and—in fashion similar to that just described, except for stretching noted below—passed over and downward relative to tip 28*a*, forcing loop 40 near exterior layer 38*a* into engagement with a corresponding notch 32*a*. The spacing Δ between tips 28 is desirably about 33% longer than half the periphery of loop 40, such that the material of handle 14 and of adjacent upper portion 42 of liner 12 is stretched in the above process. For purposes of this stretching, surface 30 (not visible in FIG. 1) of ear 18*a* serves as a fulcrum point for the user's thumb, readily allowing the index finger to pull loop 40 over tip 28*a* and downward into engagement with notch 32*a* before removing the index finger. Thereafter, the released loop 40 contracts slightly, but the usual gap is eliminated because portion 42 is pulled tautly against wall 17 (and even onto rim 22*a* adjacent wall 17 because of horizontal folding of the material) as a result of the stretching. This follows because the path around notches 32, 32*a* is about 25% longer than original loop 40*i* (about 13 inches in ID). On the other hand, the material of upper portion 44 of liner 12 beyond handles 14 may not need stretching, upper portion 44 still tending to curl over rim 22 in that case because of the downward pull when loop 40 is placed under notch 32 (as best seen at 46 in the partial view of FIG. 3). Thus, the undesirable gaps of the prior art are eliminated.

For removal of liner 12 after it is filled with refuse, the foregoing sequence is reversed, the user's thumb again being rested on surface 30 to facilitate stretching loop 40 enough to clear the selected one of the tips 28, 28*a* (assuming that liner 12 is being released from the same end of container 10 on which attachment was just described).

In a preferred embodiment, trash container 10 has a rectangular opening (about 7.3" by 13") with narrow-end walls 16 and is provided with four integral ears 18, one at each corner 20, arranged in opposing pairs 18,18*a* and 18*b*,18*c* aligned on walls 17; each opposing pair having respective tips 28 spaced about 8.5 inches apart such that tips 28 protrude outboard about ½ inch beyond and 1 inch above rim 22, a notch 32 about ½ inch long being located in an exterior layer 38 adjacent corner 20 of container 10 at least flush with—or lower than—an outer lip 24 of rim 22 which lies about ½ inch below this last. Height of walls 16, 17 is not critical because the strength of the preferred bags used as liners 12 will sustain heavy, square-cornered loads like two boxes containing six 12 oz. cans of soda apiece.

While the above description was given in terms of the preferred plastic bags, should these be unavailable then known handleless bags of the same overall size and made of similar material could be modified in a simple manner for use as liners 12 by, say, punching circular strain-relief holes in both sides of each bag at two appropriately spaced points (spacing about half the periphery of loop 40 internal to handles 14 of the preferred liners identified above) and then slitting the bag material along a line between the holes. Trash container 10 can also utilize oversize handleless plastic bags of any type without the foregoing modification, or paper bags in known fashion. It may therefore be termed a "multi-liner" unit because of its versatility in this respect.

It may also be remarked that while integral members are preferred, sets of ears 18 could be fabricated of suitable material (e.g. plastic) and fastened to the exterior of container 10 (by provision, say, of a channel-formed base for straddling rim 22*a* in a close fit and interlocking with lip 24 by known resilient integral catches, or otherwise by use of bolts having a flat head—the head located on the interior of container 10, naturally). Attachment orientation would be as in FIG. 1, of course. This alternative, though not preferred, is contemplated and intended to come within the scope of the appended claims, as are other modifications likewise falling within the spirit of the invention.

I claim:

1. In a trash/garbage container of the leak-proof, molded type having two end walls with a juncture at each lateral end thereof to a respective one of two side walls and defining a substantially rectangular opening at a top edge of the walls, together with a closure-forming bottom piece attached to a lower edge of each wall to form a cavity; the improvement comprising:

(a) a pair of spaced projecting members on said end walls, one member of said pair adjacent each said juncture; each said projecting member being oriented essentially at right angles to a respective one of said side walls and having a tip terminating outboard of said respective one side wall, (b) a bag liner insertable in said cavity, said liner being made of flexible, extensible material and having an upper end with handle loops thereon for carrying said liner and for engagement with said projecting members, the spacing of said projecting members being sufficiently large relative to said handle loops as to maintain said loops in a stretched state when engaged therewith, and (c) means on said projecting members holding at least a portion of said loops externally of said cavity and below said top edge of the walls, whereby said projecting members are located externally of said cavity and support said liner in substantially wall-hugging and unobstructedly removable relation to said walls when engaged with said handle loops.

2. The trash container of claim 1, wherein said tip is angular in shape and terminates above said top edge and said projecting members have a base lying at least flush with the top edge in solid attachment to a respective end wall, both said tip and an outward terminus of said base lying outboard of said side wall.

3. The trash container of claim 1, wherein said top edge is an inverted channel having a lower lip and said holding means comprises a notch in each said projecting member, said notch lying below said tip and at least flush with said lower lip.

4. The trash container of claim 1, wherein said top edge of at least the container side walls has a wide, outwardly extending rim and said tip terminates outboard of said rim.

5. The trash container of claim 1, wherein said bag has sides extraneous to said handle loops and interconnecting the loops at said upper end of the liner, said sides having an upper portion curled over said top edge of the container side walls upon engaging said handle loops with said notches.

6. The trash container of claim 5, wherein said top edge of at least the container side walls has a wide, outwardly extending rim and said tip terminates outboard of said rim.

7. In a trash/garbage container of the leak-proof, molded type having two end walls with a juncture at each lateral end thereof to a respective one of two side walls and defining a substantially rectangular opening at a top edge of the walls, together with a closure-forming bottom piece attached to a lower edge of each wall to form a cavity; the improvement comprising:

(a) a pair of spaced projecting members on said end walls and aligned therewith, one member of said pair adjacent each said juncture, each said projecting member having a tip, a substantially rigid fulcrum point, and a holding notch; said tip, fulcrum point, and notch each terminating outboard of said respective one side wall, (b) a bag liner insertable in said cavity, said liner being made of flexible, extensible material and having an upper end with handle loops thereon for carrying said liner and for engagement with said projecting members, the spacing of said projecting members being sufficiently large relative to said handle loops as to maintain said loops and upper liner edge in a wall-hugging and edge-covering stretched state when engaged therewith, and said notches holding at least a portion of said loops externally of said cavity and below said top edge of the walls, whereby said projecting members are located externally of said cavity and support said liner in a non-slip, wall-hugging and unobstructedly removable relation to said walls when engaged with said handle loops.

8. The trash container of claim 7, wherein said tip is angular in shape and terminates above said top edge and said projecting members have a base lying at least flush with the top edge in solid attachment to a respective end wall, and an outward terminus of said base lying outboard of said side wall.

9. The trash container of claim 7, wherein said top edge is an inverted channel having a lower lip and said notch lies below said tip and at least flush with said lower lip.

10. The trash container of claim 7, wherein said bag has sides extraneous to said handle loops and interconnecting the loops at said upper end of the liner, said sides having an upper portion curled over said top edge of the container side walls upon engaging said handle loops with said notches.

11. The trash container of claim 10, wherein said top edge of at least the container side walls has a wide, outwardly extending rim and at least said tip terminates outboard of said rim.

* * * * *